United States Patent [19]

Freiborg

[11] Patent Number: 4,768,318

[45] Date of Patent: Sep. 6, 1988

[54] ASPHALT COMPOSITION STARTER AND FLASHING

[76] Inventor: Bennie Freiborg, 3936 Madison Rd., Flintridge, Calif. 91011

[21] Appl. No.: 940,785

[22] Filed: Dec. 11, 1986

[51] Int. Cl.[4] ..... E04D 1/30

[52] U.S. Cl. ..... 52/96; 52/58; 52/528

[58] Field of Search ..... 52/43, 54, 57, 58, 96, 52/518, 519, 523–530, 535

[56] References Cited

U.S. PATENT DOCUMENTS

| | | | |
|---|---|---|---|
| 1,683,285 | 9/1928 | Butterick | 52/518 |
| 1,689,290 | 10/1928 | Mills, Jr. | 52/557 |
| 2,855,872 | 10/1958 | Tiernan | 52/96 |
| 3,894,376 | 7/1975 | Shearer | 52/518 |
| 3,903,340 | 9/1975 | Shepherd | 428/77 |
| 3,905,165 | 9/1975 | Kniesel | 52/58 |
| 3,913,294 | 10/1975 | Freiborg | 52/518 |
| 4,322,928 | 4/1982 | Freiborg | 52/521 |
| 4,404,783 | 9/1983 | Freiborg | 52/518 |
| 4,439,955 | 4/1984 | Freiborg | 52/57 |
| 4,580,389 | 4/1986 | Freiborg | 52/747 |
| 4,593,512 | 6/1986 | Funaki | 52/519 |
| 4,637,191 | 1/1987 | Smith | 52/522 |

FOREIGN PATENT DOCUMENTS

| | | | |
|---|---|---|---|
| 620185 | 5/1961 | Canada | 52/525 |

OTHER PUBLICATIONS

H. F. Watson Co., Watson Dealer Prices-10/10/1928, pp. 1-6.

*Primary Examiner*—John E. Murtagh
*Assistant Examiner*—Andrew J. Rudy
*Attorney, Agent, or Firm*—Blakely, Sokoloff, Taylor & Zafman

[57] ABSTRACT

An asphalt composition roofing starter which functions as both a starter and flashing is disclosed. The starter is preferably made from the same asphalt composition roofing material as the roof itself, and comprises a rectangular portion for nailing in plurality to the lower edge of a roof in side by side abutting relationship, and an integral downward extending flashing-like portion which may serve as the flashing on a new roof, or alternatively, covering existing metal flashing in reroofing applications, in either event being more compatible with the main roof covering itself and not requiring the usual periodic repainting characteristic of ordinary flashing. The downward extending portion of the starter is wider than the upper rectangular portion by extending beyond either one or both ends of the upper rectangular portion so as to provide an overlap to avoid any visible split or opening between the adjacent starters. Preferably the starter is folded a full 180 degree along the line between the rectangular portion and the downward extended portion at the time of manufacture, and shipped in the folded condition, being unfolded by 90 degrees plus the roof pitch angle at the time of installation.

6 Claims, 1 Drawing Sheet

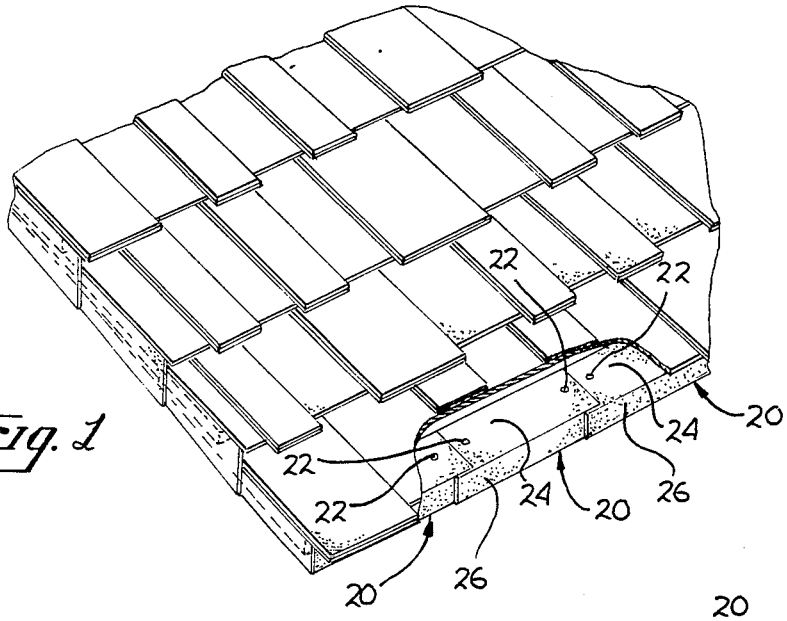
Fig. 1
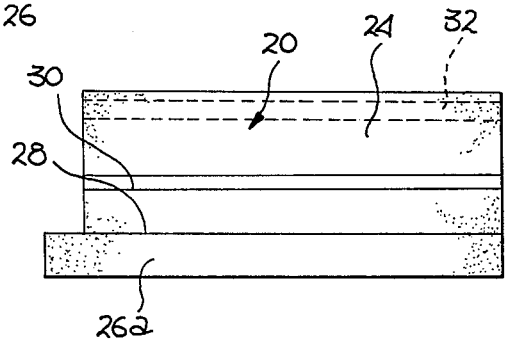
Fig. 5
Fig. 2
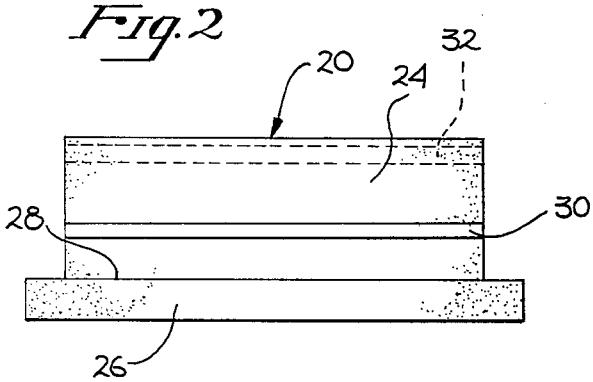
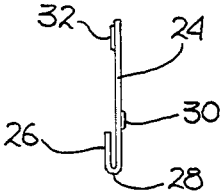
Fig. 3
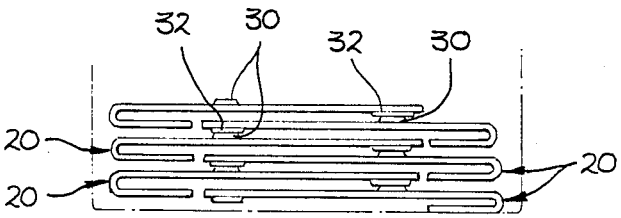
Fig. 4

ASPHALT COMPOSITION STARTER AND FLASHING

BACKGROUND OF THE INVENTION

1. Field of the Invention.

The present invention relates to asphalt composition roofing.

2. Prior Art.

Asphalt composition roofing of various types and patterns, including various types of shingles, are well known in the prior art. For a long time such roofing was recognized as being relatively inexpensive, easy to install, of long life and fire resistant, at least in comparison to materials like wood shake, but in general did not have much decorative effect because of the uniform color and lack of meaningful thickness to provide any meaningful three dimensional appearance. In more recent years however, asphalt composition roofing products have become available which are more decorative in design, dimensional characteristics and coloration. By way of example, shingles are available which, when installed, have a geometric pattern somewhat resembling a spaced apart shake roof or a slate roof. Such shingles are relatively thick, at least toward the lower end thereof to give a reasonable three dimensional appearance to the roof, and are also available with the lower ends of the shake-like projections being of a lighter shade than the rest thereof, enhancing the shadow effect to give the roof a greater three dimensional appearance. The inventor of the present invention has produced and sold an asphalt composition hip and ridge cover in accordance with U.S. Pat. No. 3,913,294, which gives a real three dimensional outline to the hip and ridge of asphalt composition roofs, so that today asphalt composition roofs can be quite attractive as well as fire resistant and of reasonable cost.

Typically, when installing an asphalt composition roof, a metal flashing will first be nailed to the lower edge of the roof, and having a portion thereof bent downward to hang below the lower edge of the roof by approximately two inches. For this purpose a piece of galvanized steel is used, with the flashing being painted a color approaching the color of the asphalt composition roofing material installed in courses thereabove to provide an apparent depth or thickness at the roof edge when installed and painted as described. Because the front edge of a roof normally is not perfectly straight and level, the flashing is frequently rippled and bent during installation. With time, the flashing may become bent much more by encounters with tree limbs, ladders and the like. Further, it is normally painted with ordinary house paint, wherein the paint adhesion is less than ideal, with chipping or peeling of the paint exposing the shiny metal thereunder to grossly degrade the esthetic characteristics thereof. Also the metal flashing only extends a short distance under the lower edge of the roof shingles, and is not fastened thereto or sealed with respect thereto. Therefore rain can frequently seep under the lower edge of the shingles, over the upper edges of the flashing and then thereunder, soaking the wood in that region. In moist environments, this frequently results in premature deterioration and rotting of the lower edge of the roof. Still the metal flashing remains the industry standard approach to finishing the lower edge of an asphalt composition roof.

The purpose of the present invention is to offer an alternative, one which does not need painting, will return to its original position after being inadvertently deflected and which is perfectly compatible with the asphalt composition roof itself since it is intended to be manufactured out of the same basic composition as the shingles are made from. In that regard, a multipurpose roof piece and a method of forming a roof piece are disclosed in U.S. Pat. Nos. 4,404,783 and 4,580,389 respectively. One of the intended uses of this roof piece is as a starter, with an edge thereof of the same width as the body being bent downward to serve the purpose of the flashing. This type of starter however, has the disadvantage that unless the edges line up perfectly, one can see light between the starter panels, creating the impression of a plurality of individual tabs extending downward rather than the desired impression of apparent thickness of the roof. Gaps between these tabs may be created not only by improper installation but also by waviness in the lower edge of the roof and misalignment so that one tab is forward or behind the adjacent one. In U.S. Pat. No. 4, 322,928, a somewhat similar starter is shown, this one shown installed in an overlapping manner. While this overcomes the gap problem hereinbefore referred to, it does so at the expense of an uneven lower edge surface of the roof, making the lower edge of the first course somewhat irregular. Accordingly, the purpose of the present invention is to provide a starter of simple design for overcoming the various problems of the prior art.

BRIEF SUMMARY OF THE INVENTION

An asphalt composition roofing starter which functions as both a starter and flashing is disclosed. The starter is preferably made from the same asphalt composition roofing material as the roof itself, and comprises a rectangular portion for nailing in plurality to the lower edge of a roof in side by side abutting relationship, and an integral downward extending flashing-like portion which may serve as the flashing on a new roof, or alternatively, covering existing metal flashing in reroofing applications, in either event being more compatible with the main roof covering itself and not requiring the usual periodic repainting characteristic of ordinary flashing. The downward extending portion of the starter is wider than the upper rectangular portion by extending beyond either one or both ends of the upper rectangular portion so as to provide an overlap to avoid any visible split or opening between the adjacent starters. Preferably the starter is folded a full 180 degree along the line between the rectangular portion and the downward extended portion at the time of manufacture, and shipped in the folded condition, being unfolded by 90 degrees plus the roof pitch angle at the time of installation.

BRIEF DESCRIPTION OF THE DRAWINGS

FIG. 1 is a perspective view of a portion of a roof with the asphalt composition shingles cut away to illustrate the typical installation of the starter of the present invention.

FIG. 2 is a plan view of the starter of the present invention.

FIG. 3 is a side view of the starter illustrating the manner in which it is folded at the time of manufacture.

FIG. 4 is schematic illustrating the manner of stacking of the starters for shipment.

FIG. 5 is a plan view of an alternate embodiment starter in accordance with the present invention.

DETAILED DESCRIPTION OF THE INVENTION

First referring to FIG. 1, a perspective view of a portion of a roof covered with the asphalt composition shingle of U.S. Pat. No. 4,322,928 and having a portion thereof cut away to illustrate a typical application of the present invention may be seen. The asphalt composition shingles of the '928 patent are shown for exemplary purposes only, as substantially any asphalt composition shingle may be used with the present invention. In particular, asphalt composition roofing materials are typically laid in courses starting at the lower edge of the roof and working upward to the ridge. Prior to the installation of the first course, some form of starter or metal flashing is typically attached to the lower edge of the roof and bent downward to extend below the edge by approximately two inches. This flashing gives the roof a better appearance by providing an apparent thickness thereto, and helps prevent rainwater from getting under the bottom edge of the lowest course to keep the roof dry in that area.

In the present invention, individual starter pieces, each generally indicated by the numeral 20, are used. Each starter piece is nailed in position by a pair of nails 22, with the portions 24 thereof butting the adjacent starter pieces and with the lower portions 26 thereof overlapping the corresponding portion of the next adjacent starter.

Now referring to FIG. 2, the planform of the starter of FIG. 1 may be seen. In general, each starter piece is an integral piece of asphalt composition material having a top surface of granules, an intermediate layer of asphalt and an asphalt saturated base thereunder, typically of felt or fiberglass. Each starter is comprised of two major portions, specifically the upper rectangular portion 24 for nailing on the lower edge of the roof in plurality in end to end abutting relationship, and a lower portion 26 which in this embodiment is somewhat longer than portion 24 so as to extend beyond both ends thereof to overlap the corresponding ends of portion 26 of the adjacent starters, as illustrated in FIG. 1. In the preferred embodiment, region 24 is approximately 18 inches long, that is, will cover approximately 18 inches of roof lower edge, with region 26 being approximately ½ inch longer on each end or 1 inch longer overall than region 24. Other lengths may be used if desired, though lengths covering some multiple of six inches of roof lower edge are preferred to space the junction between starters regularly with respect to the normal rafter spacing. The width of region 26, which of course is the amount that portion extends downward from the edge of the roof, is preferably approximately 2 inches in accordance with prior art metal flashing, with the region 24 together with the width of region 26 preferably being some dimension which in plurality will extend across the width of a standard roll of asphalt composition roofing material. Thus in the preferred embodiment illustrated, the width of region 24 is approximately 7 inches, giving an overall width of the starter of this embodiment of nine inches, allowing four such starters to be laid out across the width of a standard 36 inch roll of asphalt composition material. In that regard, with the approximate dimensions given, the starters may be laid out with two starters staggered lengthwise across the roll, or four side by side across the roll, laid out with the length thereof running in the direction of the roll. The starters may also be cut from material 39 ⅜ inches wide, still leaving the desired face with the balance used as underlayer region 24. In any event, once the starters are cut from the roll of material, they are folded along line 28 by 180 degrees so that the substrate side of region 26 lies against the substrate side of region 24 thereof, as illustrated in FIG. 3. This bending, being done in plant at the time the roll material is at room temperature or warmer, may be easily done without cracking of the material or excessive loss of the granules from the region of the bend. Similarly, at the time of installation, region 26 may be unfolded from region 24 to the proper angle, with the unfolding tending to close any separation of the granules caused by the original folding. In that regard, while the starters could be shipped flat and bent at the time of installation as required, a cold bend in the direction required may be more difficult and give less desirable results than the corresponding unfolding would at the time of installation.

Once folded, the starters may be readily stacked as illustrated in FIG. 4 and wrapped in a plastic or cardboard wrap for shipping by pallet. As shown in FIG. 4, the starters are alternated in direction as well as being alternated right side up and up side down to provide a compact high density shipping package. For stability in the stacks, some layers may be placed 90 degrees with respect to other layers to form a criss-cross pattern to provide greater stability in the stack.

Referring again to FIG. 1, it will be noted that the overlapping of the ends of the downward extending portions 26 are shown preferably alternated so that in the installation shown in FIG. 1, the left end of portion 26 of one starter overlies the right end of portion 26 of the adjacent starter. With such an overlap the objectives of the invention are achieved by the overlap stated essentially tying the lower part of the starters together even if the right end of region 26 of each starter does not extend beyond the corresponding side of region 24. Accordingly, while the starter of FIG. 2 is preferred, a starter generally in the shape illustrated in FIG. 5 would also provide the objects of the invention, wherein region **26*a* extends beyond the side of region 24** only at one side thereof.

Generally it is required that the lower edge of the roof be fastened down to prevent the wind from getting thereunder. The prior art metal flashing in general has no provision for this and accordingly, it is common practice to put down a starter row of shingles in the position of the lower course and then put a second layer of shingles thereover as the lower course so that the second layer of shingles may bond to the first layer by way of the adhesive normally used to secure each course to the adjacent course. The double layer of shingles on the lower course, and only the lower course, generally results in a visible increase in thickness in the roof covering in this region. In the present invention, on the other hand, the need for the double layer of shingles on the lower course may be eliminated by putting an appropriate adhesive strip 30 (See FIGS. 2 through 5) on the starters of the invention. Such an adhesive strip may be by way of example an asphalt adhesive on the top surface of the starter. By placing the adhesive strip at a position on region 24 spaced away from the fold line 28 by an amount equal to or exceeding the width of region 26, an appropriate release 32 may be positioned on the lower side or underside of the starter adjacent the upper edge of region 24 so that when the starters are folded and stacked as shown in FIG. 4, the adhesive strip 30 of one starter is covered by the release 32 on the adjacent starter to prevent the starters from bonding together in warm weather. The release 32, by way of example, may be an appropriate strip of plastic tape or a wax coated area, with the wax being applied by a spray roller or other mechanism. Thus not only will the starter of the present invention provide a better looking roof than a prior art metal flashing will provide, but also will eliminate the need for the double layer of shingles around the lower edge of the roof, thereby resulting in a savings probably exceeding the cost of the starters themselves.

The starters of the present invention are actually easier to install than flashing, primarily because one is not attempting to wrestle a long strip of sheet metal at any one time, but rather an individual starter of limited length. Also, the starters of the present invention will not tend to wrinkle or bend like metal flashing, partially because adjacent starters may readily accommodate some angularity therebetween and partially because the starters only need be fastened down adjacent the ends thereof. Finally, of course, the water seal provided by the starters of the present invention is far superior to that provided by a metal flashing as the portion of the starters of the present invention which underlies the first course of shingles extends much further up the roof than typical metal flashing, preventing water from penetrating that far to pass over the top of the starters. Water entrance of course is highly inhibited in the preferred embodiment by use of the asphalt adhesive which provides a seal as well as a tie down for the lower edge of the starter course of shingles.

There has been disclosed and described herein a new and unique starter for use with asphalt composition roofing which is easily installed, particularly compatible with asphalt composition roofing systems and most asthetically complimentary therewith, which is not subject to the peeling of paint and needed periodic repainting. While the starter may be bent at the time of installation to the desired angle, preferably the starter is folded in plant while warm so that it may be unfolded to the extent necessary at the time of installation. Folding in plant in this manner minimizes any separation because the folding may be accomplished when the starter is warm and of course may be readily done on automatic folding equipment on a continuous or discontinuous basis without having to actually define the fold line 28 by any scoring or any other fold line definition. While it is preferable to have the lower portion of the starter extend in width beyond both ends of the mounting portion thereof, such is not a necessity as hereinbefore explained. Thus while the preferred embodiments of the present invention have been disclosed and described herein, it will be understood by those skilled in the art that various changes in form and detail may be made therein without departing from the spirit and scope of the invention.

I claim:

1. A combined starter and flashing course on the lower edge of a roof comprising a plurality of starter and flashing units, each being a unitary sheet of asphalt composition roofing material having an asphalt impregnated base, a layer of asphalt and a top layer of granules, said unitary sheet having an upper first portion having first and second sides and first and second ends, and a lower second portion having first and second sides and first and second ends, said second side of said first portion being integrally joined to said first side of said second portion, said second portion having a length between said first and second ends thereof which is greater than the length between said first and second ends of said first portion, said starter and flashing units each having said first portions thereof fastened to a roof adjacent the lower edge thereof with a line between said first and second portion thereof approximately at the lower edge of the roof, each starter and flashing unit being fastened to the roof so that said second end of the first portion of a respective starter and flashing unit substantially abuts the first end of the first portion of a next adjacent starter and flashing unit to form a starter course on the roof, said second portions thereof being bent downward to serve as a flashing along the lower edge of the roof with said second end of the second portion of each respective starter and flashing unit and the first end of the second portion of a next adjacent starter and flashing unit overlapping each other.

2. The combined starter and flashing course of claim 1 wherein for each starter and flashing unit, one end of said second portion overlies the opposite end of one adjacent combined starter and flashing unit and the other end of said second portion underlies the opposite end of the other adjacent combined starter.

3. The combined starter and flashing course of claim 1 wherein, for each starter and flashing unit, said first end of said second portion extends beyond said first end of said first portion.

4. The combined starter course of claim 1 wherein, for each combined starter and flashing unit, each of said first and second ends of said second portion extend beyond said first and second ends, respectively, of said first portion.

5. The combined starter and flashing course of claim 1 wherein said first portion has adhesive on the top surface thereof adjacent the second side thereof.

6. The combined starter and flashing course of claim 5 wherein said first portion has a release agent on said base adjacent said first side thereof, said adhesive and said release agent being cooperatively disposed so as to face the release agent and adhesive, respectively, on adjacent combined starter and flashing unit when stacked for shipping.

* * * * *